US005215166A

United States Patent [19]

Pipes

[11] Patent Number: 5,215,166

[45] Date of Patent: Jun. 1, 1993

[54] MOBILE STACKER FOR AUTOMATED STORAGE AND RETRIEVAL SYSTEM

[75] Inventor: George Pipes, Salt Lake City, Utah

[73] Assignee: Eaton-Kenway, Inc., Salt Lake City, Utah

[21] Appl. No.: 784,865

[22] Filed: Oct. 30, 1991

[51] Int. Cl.[5] ..... B66B 9/20

[52] U.S. Cl. ..... 187/9 R; 212/266

[58] Field of Search ..... 187/9 R, 9 E; 212/266, 212/176, 183, 271; 52/116, 296, 646, 301

[56] References Cited

U.S. PATENT DOCUMENTS 5,020,957 6/1991 Liston ..... 187/9 R 5,067,592 11/1991 Miskin et al. ..... 187/9 R

*Primary Examiner*—Robert P. Olszewski
*Assistant Examiner*—Kenneth Noland
*Attorney, Agent, or Firm*—R. A. Johnston

[57] ABSTRACT

A self-propelled mobile stacker for an automated storage and retrieval system having a mast assembly of lightweight non-metallic material removably installed on a metal chassis. The mast assembly comprises a mast and base formed of a common "I"-shaped composite with the mast secured in the vertical position exclusively by composite non-metallic material gussets adhesively bonded by epoxy to the mast and base.

24 Claims, 1 Drawing Sheet

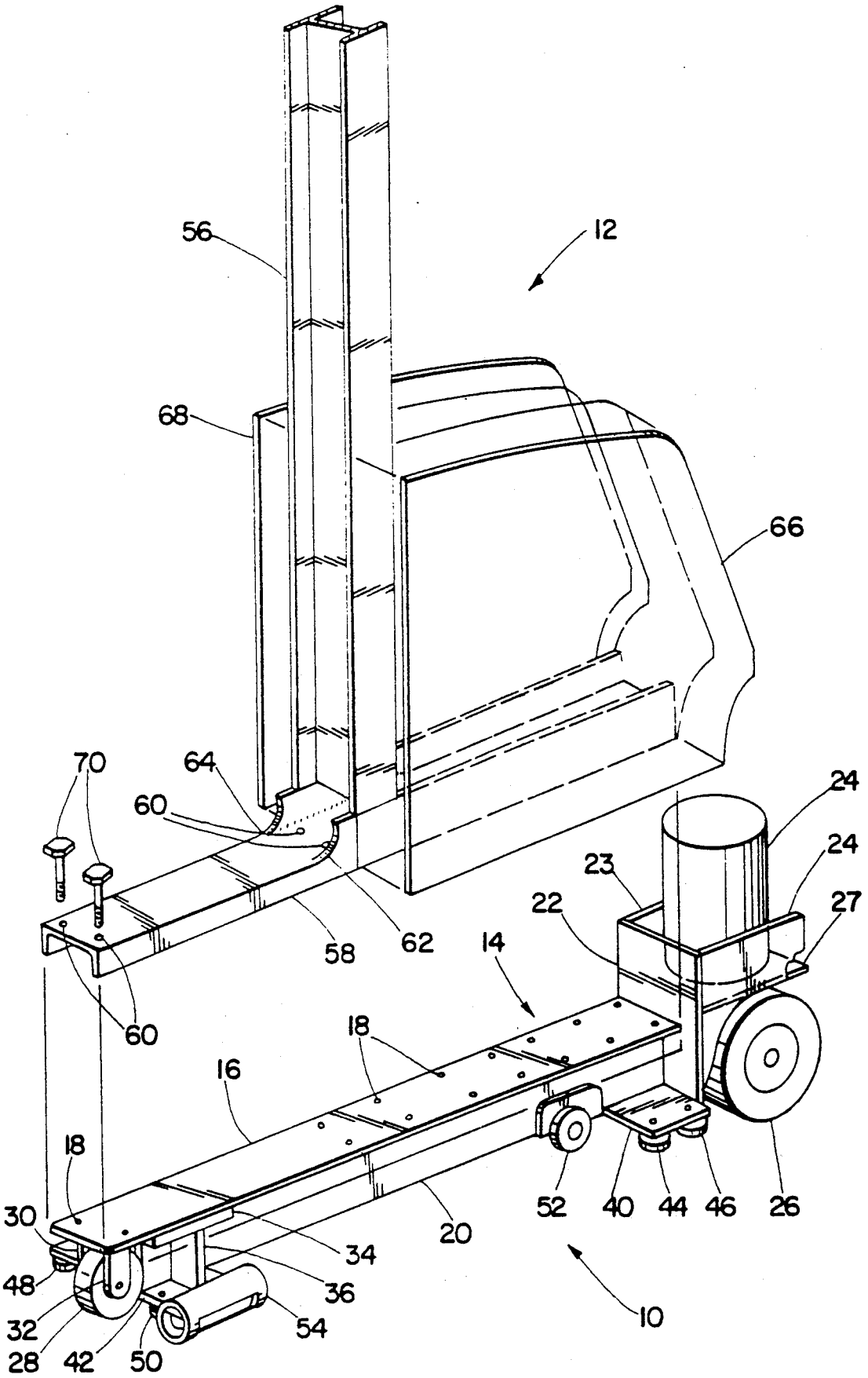
56
12
68
66
70
64
60
24
24
23
27
22
58
62
14
60
18
16
18
52
40
44
46
26
30
20
34
48
36
32
54
10
28
42
50

MOBILE STACKER FOR AUTOMATED STORAGE AND RETRIEVAL SYSTEM

BACKGROUND OF THE INVENTION

The present invention relates to automated material handling systems, and particularly those of the type employed in warehouses for retrieving articles from vertically arranged stacks. Such devices are often referred to as "stackers", and are typically rail guided and equipped with traction motive means to provide self-propelled movement between the warehouse stacks. Typically, mobile stackers of the aforesaid type employ a vertical mast mounted on the rail-guided self-propelled carriage, and have an extensible shuttle movably disposed on the mast for retrieving objects from the stacks.

Automated storage and retrieval systems of the above-described type are usually customized installations in a particular warehouse building, and require accurate location and laying of the guiding rails and alignment of the carriage and mast with respect to the stacks for enabling remote control of the self-propelled carriage and shuttle. The systems are typically erected and assembled piece by piece in the particular warehouse to be serviced. The mobile stacker, and particularly the mast assembly are usually formed of steel plate or I-beam construction requiring welding and matched drilling of holes for bolting. These structures are not only costly to assemble, by are quite heavy and thus possess a substantial inertia, which creates problems for braking of the carriage during movement to a desired position-adjacent the stacks.

It has therefore been desired to provide a mobile stacker for automated storage and retrieval systems which is light in weight and employs maximum use of prefabricated components, and which may be assembled on site in a warehouse with a minimum of assembly operations at installation.

SUMMARY OF THE INVENTION

The present invention provides a mobile stacker for an automated storage and retrieval system having light weight prefabricated mast assembly formed of non-metallic composite material. The mast assembly may be shipped separately to the site of installation and easily assembled to the self-propelled carriage for completing the stacker. The mast assembly of the present invention employs a mast formed of composite material having an "I"-shaped transverse section erected vertically on a horizontal base member, preferably formed of common material and configuration as the mast. The mast is secured in the vertical position on the base member by a pair of gussets disposed on opposite sides of the mast and secured to the mast and base by adhesive bonding, preferably of the epoxy material variety.

The adhesively bonded assembly is light in weight by virtue of the composite material construction and may be easily packaged and shipped as a separate assembly to the site of installation and readily erected by virtue of its light weight.

BRIEF DESCRIPTION OF THE DRAWINGS

The drawing is an exploded perspective view of the mast assembly and carriage for the self-propelled mobile stacker of the present invention.

DETAILED DESCRIPTION

Referring to the drawing, the mobile stacker of the present invention is indicated generally at 10 as including a mast assembly indicated generally at 12, and a carriage or chassis indicated generally at 14. The carriage 12 includes a deck plate 16 having a plurality of holes 18 provided along the margins thereof and adapted for receiving suitable fasteners therethrough. The deck plate is supported by a central spine or web plate 20 disposed in vertical orientation thereunder and attached thereto by suitable weldment. An end plate 22 is welded to the deck 16 and extends vertically above the deck. End plate 22 provides support for a tray 27 welded to the end of plate 22, and which is supported by side brackets 23,25. A traction drive motor 24 is mounted on tray 27 and extends through an opening in the bottom of tray 27 and is operatively connected to drive a traction wheel 26. The opposite end of the plate 16 has an idler wheel 28 attached thereto by a pair of downwardly disposed brackets 30,32 bolted to the underside of plate 16. Additional web and flange stiffeners 34,36 are provided and attached to the web 20 on the underside of deck 16 by weldment for providing additional stiffness.

A pair of guide plates 40,42 are disposed one under each of the opposite ends of web 20 and welded thereto. Plates 40,42 extend transversely outwardly from the web 20. Guide plates 40,42 each have a plurality of guide rollers on the opposite ends thereof, two of which are illustrated on plate 40 and denoted by reference numerals 44,46. Two of the guide rollers, one on each opposite end of the plate 42, are shown in the drawing, and are denoted by reference numerals 48,50. The guide rollers 44,46, and 48,50, are typically adapted for engaging the sides of a centrally-disposed guide rail (not shown) provided on the warehouse floor. As is known in the art, an encoder wheel for measuring the traverse of the carriage is provided on the web 20, and is denoted by reference numeral 52.

A tubular bumper or stop 54 is provided on the outer end of guide plate 42 for engaging suitable shock absorber (not shown) provided in the warehouse at the end of the region to be traversed by the stacker 14.

The mast assembly 12 comprises a vertically extending mast 56 preferably having a wide flanged "I"-shaped transverse section with the flanges disposed parallel to the sides of plate 16 of the carriage. The mast has its lower end resting on the edges of the flanges of an elongated base member 58, which preferably has a similar "I"-shaped transverse section and disposed with the central web thereof horizontal or parallel to the surface of the deck plate 16.

The mast 56 is preferably formed of composite non-metallic material, preferably, for example, a resinous matrix having fibrous fillers therein. The base member 58 has portions of the upper edges of the flanges 60,62 cut away to provide additional clearance for a powered extensible shuttle carrier (not shown) which moves up and down on the mast 56 as known in the art. The base member 58 is preferably formed of the same material as the mast 56; and, in the present practise of the invention, the base member 58 and mast 56 are formed from a common length of "I"-shaped composite material. In the presently preferred practise for light shuttle loads, not exceeding fifty (50) kilograms, the mast 56 has a flange width of twelve (12) inches (305 mm), web depth of twelve (12) inches (305 mm), and flange and web thickness of ½ inch (12.7 mm), and a length on the order of four (4) meters.

The mast 56 is secured to the base and maintained in a vertical orientation with respect thereto by a pair of gussets or side plates 66,68 disposed on opposite sides of the mast 56 and base 58. The gussets 66,68 are secured to the outer faces of the flanges of the mast and base by adhesive bonding. In the presently preferred practise, the adhesive bonding of the gussets to the base and mast member employs epoxy resin type adhesive, and is the exclusive means for maintaining the mast 56 supported vertically in position on the base member.

In the presently preferred practise, the mast 56, base 58, and gussets 66,68 are formed of a fire-retardant isophalic polyester resin system composite material containing ultra-violet inhibitors bearing manufacturer's type designation FRP525 and available from Morrison Molded Fiberglas Co., AFC Division, Highway 52 South, Chatfield, Minn. 55923.

The subassembly 12 comprising mast 56, gussets 66,68, and base member 58 in the present practise of the invention, has base member 58 received over the plate 16 which is nested between the flanges of the base member 58 and is secured to the plate 16 by fasteners such as bolts 70 received through each of the holes 16,18.

The present invention thus comprises a unique and novel mobile stacker for an automated storage and retrieval system having a steel carriage adapted for being rail-guided on the floor of a warehouse, and having traction motive means thereon to render the unit self-propelled. The carriage has attached thereto a mast assembly formed of non-metallic composite material comprising a vertical I-beam mast and horizontal I-beam base member with the mast secured thereto exclusively by a pair of gussets adhesively bonded to the mast and base member such as with epoxy resin material.

The present invention thus provides a light weight mobile stacker which is easily assembled in situ and is capable of being prefabricated and shipped with the mast assembly dismantled from the carriage.

Although the invention has hereinabove been described with respect to the embodiment illustrated in the drawing, it will be understood that the invention is capable of modification and variation, and is limited only by the scope of the following claims.

I claim:

1. A mobile stacker for an automated storage and retrieval system comprising:

(a) a rigid chassis suspended from a plurality of traction wheels and including motive means for driving said wheels;

(b) a mast assembly adapted for having a load receiving shuttle movably mounted thereon, said mast assembly having:

(i) a vertically extending mast formed of non-metallic material;

(ii) a horizontal base member formed of non-metallic material and disposed under said mast and extending outwardly therefrom;

(iii) a pair of gussets formed of non-metallic material disposed on opposite sides of said mast member, with each of said gussets adhesively secured to base member and said mast for structurally supporting said mast in vertical arrangement on said base member, wherein said mast is adapted to have a load receiving shuttle movably mounted thereon; and, (c) means for removably fast fastening said mast assembly to said chassis.

2. The stacker defined in claim 1, wherein said mast assembly is removably fastened to said chassis by threaded fasteners.

3. The stacker defined in claim 1, wherein said mast member and said base member have a common "I"-shaped transverse section.

4. The stacker defined in claim 1, wherein said mast and base members are formed of a common resinous composite material.

5. The stacker defined in claim 1, wherein said mast, base member, and gussets are formed of a composite of resinous material and fibrous material.

6. A mast assembly for an automated storage and retrieval system of the type having a load shuttle movably mounted on the mast, said mast assembly comprising:

(a) an elongated mast disposed to extend vertically and adapted to have a load shuttle movably mounted thereon;

(b) a base disposed to extend horizontally under the lower end of said mast and extending outwardly therefrom and adapted to be removably attached to a carriage; and, (c) a pair of gusset members each adhesively joined to said mast and said base on opposite sides thereof exclusively structurally supporting said mast in the vertical position on said base member, said mast, base, and gussets are formed of non-metallic material, wherein said mast and base have a common transverse section.

7. The mast assembly defined in claim 6, wherein said mast, base, and gussets are formed of a common material.

8. The mast assembly defined in claim 6, wherein said mast and base have an "I"-shaped transverse section.

9. The mast assembly defined in claim 6, wherein said mast and base are formed of material having a common "I"-shaped transverse section.

10. The mast assembly defined in claim 6, wherein said mast and base are formed from a common member having a uniformly "I"-shaped transverse section.

11. The mast assembly defined in claim 6, wherein said mast and base are formed of a composite employing isophalic polyester resin material.

12. The mast assembly defined in claim 6, wherein said mast, base, and gussets are formed of a composite employing isophalic polyester resin material.

13. The mast assembly defined in claim 6, wherein said base has a generally "I"-shaped configuration disposed with the faces of the flanges thereof extending vertically with the lower end of said mast registered on the edges of said flanges.

14. A stacker for an automated storage and retrieval system, the combination comprising:

(a) the mast assembly defined in claim 6;

(b) a carriage including a traction drive; and, (c) mechanical fastening means received through said base member intermediate said gussets and operative to secure said base member to said carriage.

15. The combination defined in claim 14, wherein said base member has a generally "I"-shaped transverse section; and, said fastening means comprises a plurality of bolts spaced along the web of said I-shape.

16. A stacker assembly for an automated storage and retrieval system comprising:

(a) a mast subassembly adapted for having a load receiving shuttle movably mounted thereon including:
(i) a mast formed of non-metallic material;
(ii) a horizontal base member formed of non-metallic material and disposed under said mast;
(iii) a pair of gussets formed of non-metallic material disposed on opposite sides of said mast, each of said gussets is attached to said base member and said mast by adhesive bonding for structurally supporting said mast in vertical arrangement on said base member;
(c) a wheeled carriage including traction motive means thereon; and,
(d) fastening means operative to removably secure said subassembly onto said carriage with said mast vertically disposed.

17. The assembly defined in claim 16, wherein said mast is secured to said mast and said base member exclusively by said adhesive bonding.

18. The assembly defined in claim 16, wherein said fastening means comprises a plurality of threaded fasteners having portions thereof engaging said base member.

19. The assembly defined in claim 16, wherein said mast has an "I"-shaped configuration in transverse section.

20. The assembly defined in claim 16, wherein said base has an "I"-shaped configuration in transverse section.

21. The assembly defined in claim 16, wherein said mast and base have a common "I"-shaped configuration.

22. The assembly defined in claim 16, wherein said mast and said base are composite structures formed of substantially isophalic polyester resin material.

23. The assembly defined in claim 16, wherein said base and said mast are formed of a common composite structure formed substantially of isophalic polyester resin material.

24. The assembly defined in claim 16, wherein said adhesive bonding employs epoxy material.

* * * * *